US010770779B2

(12) United States Patent
Mineart

(10) Patent No.: US 10,770,779 B2
(45) Date of Patent: Sep. 8, 2020

(54) STACKABLE ANTENNA ENCLOSURE

(71) Applicant: Winegard Company, Burlington, IA (US)

(72) Inventor: Kevin John Mineart, Wever, IA (US)

(73) Assignee: Winegard Company, Burlington, IA (US)

( * ) Notice: Subject to any disclaimer, the term of this patent is extended or adjusted under 35 U.S.C. 154(b) by 33 days.

(21) Appl. No.: 16/277,079

(22) Filed: Feb. 15, 2019

(65) Prior Publication Data

US 2019/0273301 A1 Sep. 5, 2019

Related U.S. Application Data

(60) Provisional application No. 62/637,086, filed on Mar. 1, 2018.

(51) Int. Cl.
*H01Q 1/12* (2006.01)
*H01Q 1/42* (2006.01)

(52) U.S. Cl.
CPC ..... *H01Q 1/1242* (2013.01); *H01Q 1/1207* (2013.01)

(58) Field of Classification Search
CPC ..... H01Q 1/12; H01Q 1/1207; H01Q 1/1214; H01Q 1/1242; H01Q 1/243; H01Q 1/1221; H01Q 1/3275; H01Q 1/002
See application file for complete search history.

(56) References Cited

U.S. PATENT DOCUMENTS 3,346,865 A 10/1967 Jones
3,480,178 A 11/1969 Morgan
3,485,412 A 12/1969 Hawley
4,101,895 A 7/1978 Jones
4,460,901 A 7/1984 Tricoles et al.
4,875,132 A 10/1989 Olivenbaum
5,534,880 A 7/1996 Button et al.
5,880,701 A 3/1999 Bhame et al.
6,241,222 B1 6/2001 Lang
7,006,054 B2 * 2/2006 Rosenfeld ..... H01Q 1/088 343/872
7,014,043 B2 3/2006 Raghunathan et al.

(Continued)

FOREIGN PATENT DOCUMENTS

CN 105281049 1/2016
JP 2008277885 11/2008
WO 2017082977 5/2017

*Primary Examiner* — Thai Pham

(74) *Attorney, Agent, or Firm* — Dorr, Carson & Birney PC

(57) ABSTRACT

A stackable antenna enclosure is generally dome-shaped with a top and a side wall tapering inward from its base. An antenna and associated electronic components are mounted on the interior top surface of the enclosure. A series of enclosures can be stacked together for storage or shipment, but the side wall of the enclosure includes a number of stops that limit how far the enclosure can be inserted into the interior cavity of an adjacent enclosure to prevent the antenna and related electronic components from coming into contact with the top of the adjacent enclosure. For example, the stops can be a series of vertical ribs extending radially outward from the side wall of the enclosure. The upper ends of these ribs will abut the base of an adjacent enclosure when stacked and prevent contact against the antenna and related electronic components.

17 Claims, 6 Drawing Sheets

(56) References Cited

U.S. PATENT DOCUMENTS

| | | | | |
|---|---|---|---|---|
| 7,245,267 | B2 | 7/2007 | Gottl et al. | |
| 8,368,611 | B2 | 2/2013 | King et al. | |
| 8,604,987 | B1 | 12/2013 | Doane | |
| 2008/0062067 | A1* | 3/2008 | Cislo | H01Q 1/40 343/872 |
| 2009/0066593 | A1 | 3/2009 | Jared et al. | |
| 2009/0262033 | A1* | 10/2009 | King | H01Q 19/12 343/713 |
| 2011/0006965 | A1 | 1/2011 | Kits van Heyningen | |
| 2011/0030015 | A1* | 2/2011 | King | H01Q 1/42 725/68 |
| 2013/0002515 | A1* | 1/2013 | Hills | H01Q 15/16 343/872 |
| 2013/0207868 | A1* | 8/2013 | Venghaus | H01Q 19/12 343/840 |
| 2013/0257468 | A1 | 10/2013 | Mlinarsky | |
| 2014/0057576 | A1 | 2/2014 | Monte et al. | |

* cited by examiner

STACKABLE ANTENNA ENCLOSURE

RELATED APPLICATION

The present application is based on and claims priority to the Applicant's U.S. Provisional Patent Application 62/637,086, entitled "Stackable Antenna Enclosure," filed on Mar. 1, 2018.

BACKGROUND OF THE INVENTION

Field of the Invention

The present invention relates the field of enclosures for antennas. More specifically, the present invention is a stackable antenna enclosure that protects the antenna mounted on the interior top surface of the enclosure during shipping.

Statement of the Problem

A wide variety of domes and other enclosures have been used in the past to house and protect antennas. For example, domes are often used to house movable satellite dish antennas, but enclosures are also used to protect fixed antennas. The elements of the antenna can be secured to the interior of the enclosure for structural support as well as protection from the surrounding environment. Since the enclosure is typically made of a dielectric material, such plastic or a composite, it can provide a stand-off distance between the antenna and a metal tower or vehicle carrying the enclosure, to thereby enhance the performance of the antenna.

The antenna elements can be a thin metallic film or layer of various shapes that are bonded directly to the interior surface at the top of the enclosure. A pre-amplifier and associated electrical connectors can also be placed inside the top of the enclosure. But, this configuration raises a number of concerns. Packaging and shipping each unit separately is not particularly economical due to the assembly's dimensions and relatively light weight. Stacking a plurality of units together reduces packaging and shipping costs, but creates a risk of damage to the antenna and associated electronic components if they contact the top of the adjacent enclosure when stacked. In addition, when domed or hemispherical parts are stacked and then shipped, vibration experienced during shipment can cause these parts to settle together and 'lock', making separation of adjacent parts difficult.

Solution to the Problem

The present invention addresses these concerns by providing a stackable enclosure with stops on the side wall of the enclosure that limit the degree to which adjacent enclosures can be nested together. These stops protect the antenna and associated electronic components from contacting the top of the adjacent enclosure. This also helps to protect the visible surfaces of the enclosure from physical damage and ensures no friction lock occurs between adjacent parts.

SUMMARY OF THE INVENTION

This invention provides a stackable antenna enclosure generally having a dome shape with a top and a side wall tapering inward from its base. An antenna and associated electronic components are mounted on the interior top surface of the enclosure. A series of enclosures can be stacked together for storage or shipment, but the side wall of the enclosure includes a number of stops that limit how far the enclosure can be inserted into the interior cavity of an adjacent enclosure. This protects the antenna and related electronic components from coming into contact with the top of the adjacent enclosure and helps to prevent damage. For example, the stops can be a series of vertical ribs extending radially outward from the side wall of the enclosure. The upper ends of these ribs will abut the base of an adjacent enclosure when stacked and prevent contact against the antenna and related electronic components.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
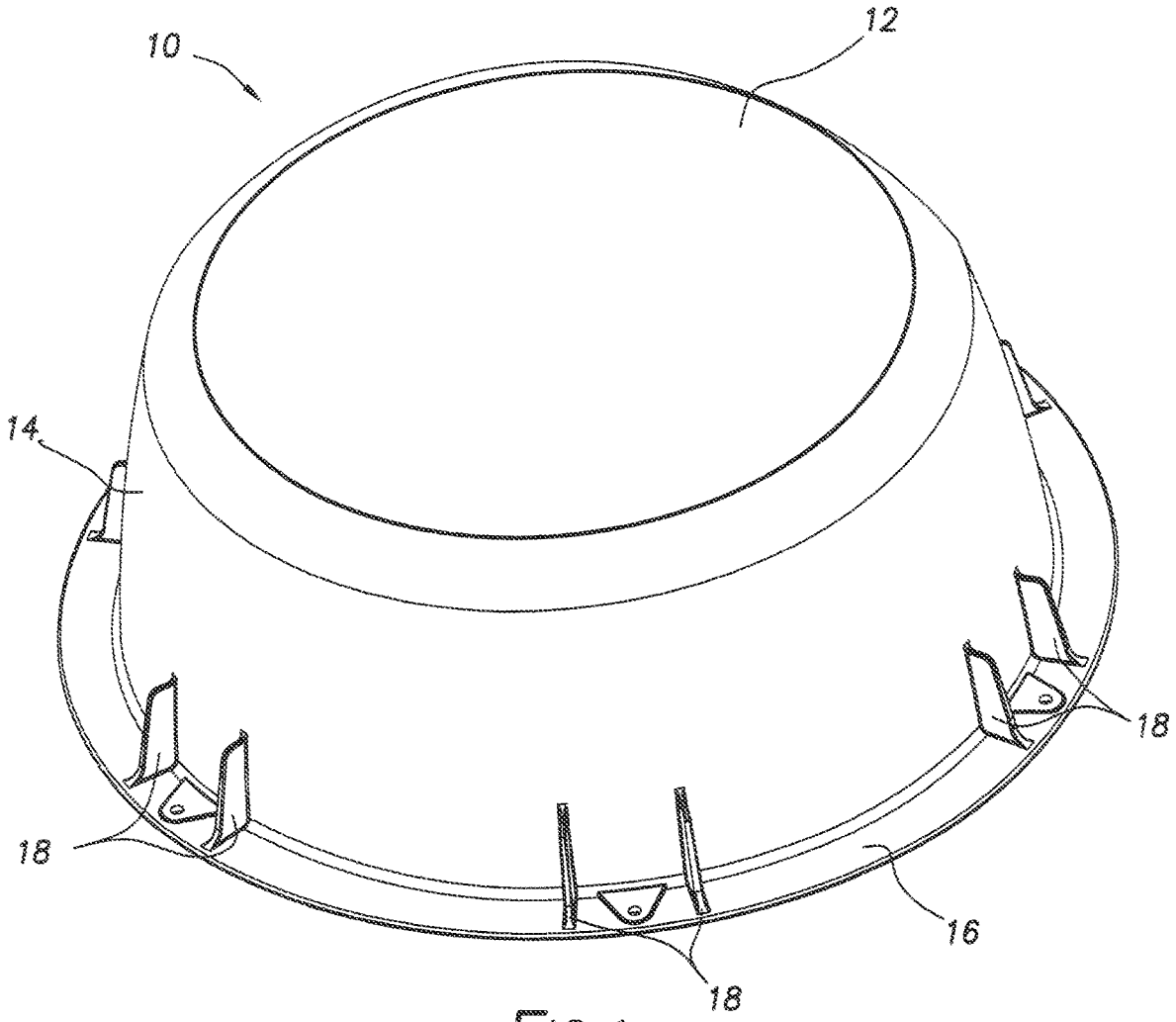
FIG. 1 is a top axonometric view a stackable antenna enclosure 10.
Figure 2:
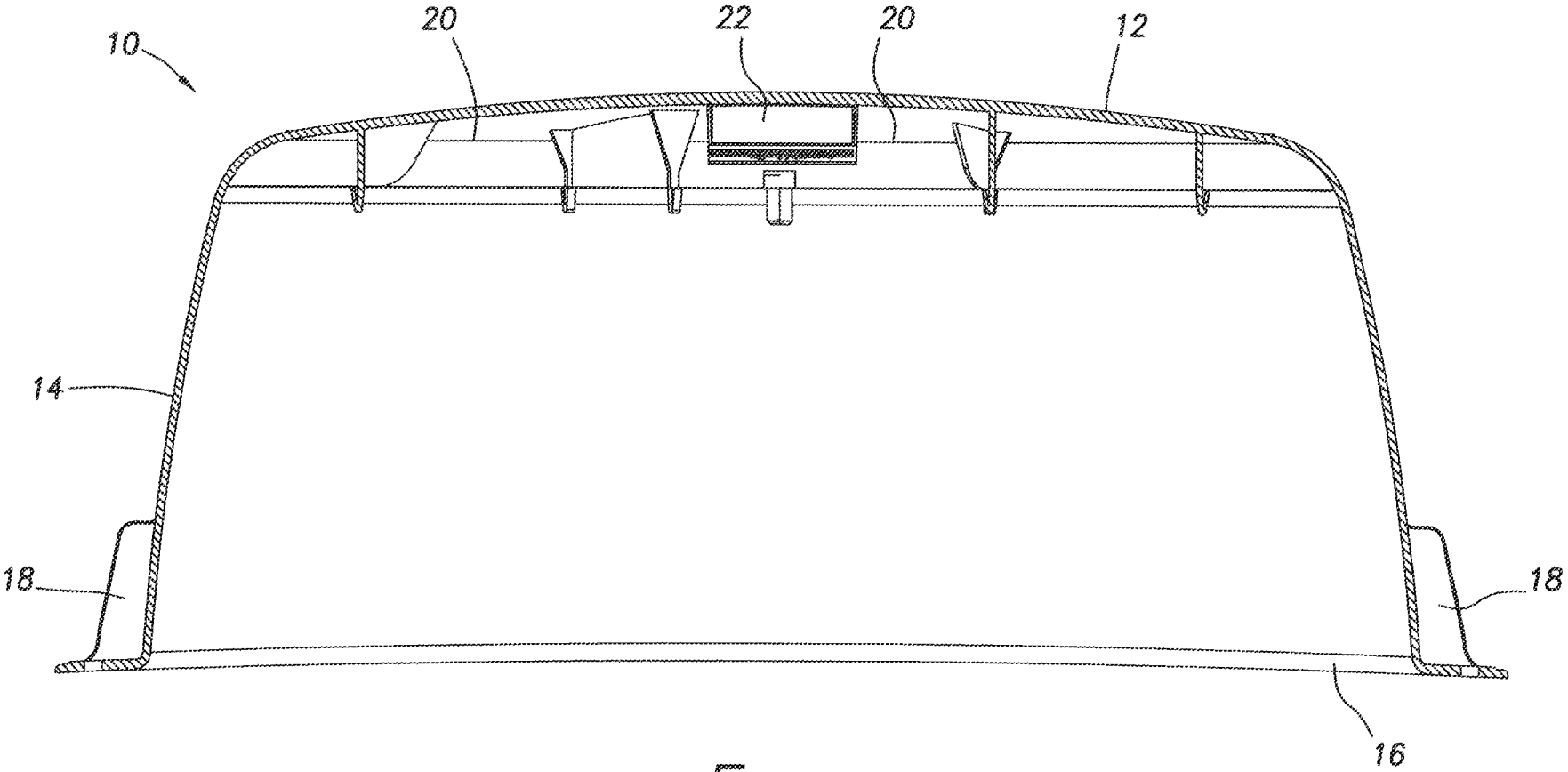
FIG. 2 is side cross-sectional view of the stackable antenna enclosure 10 corresponding to FIG. 1.
Figure 3:
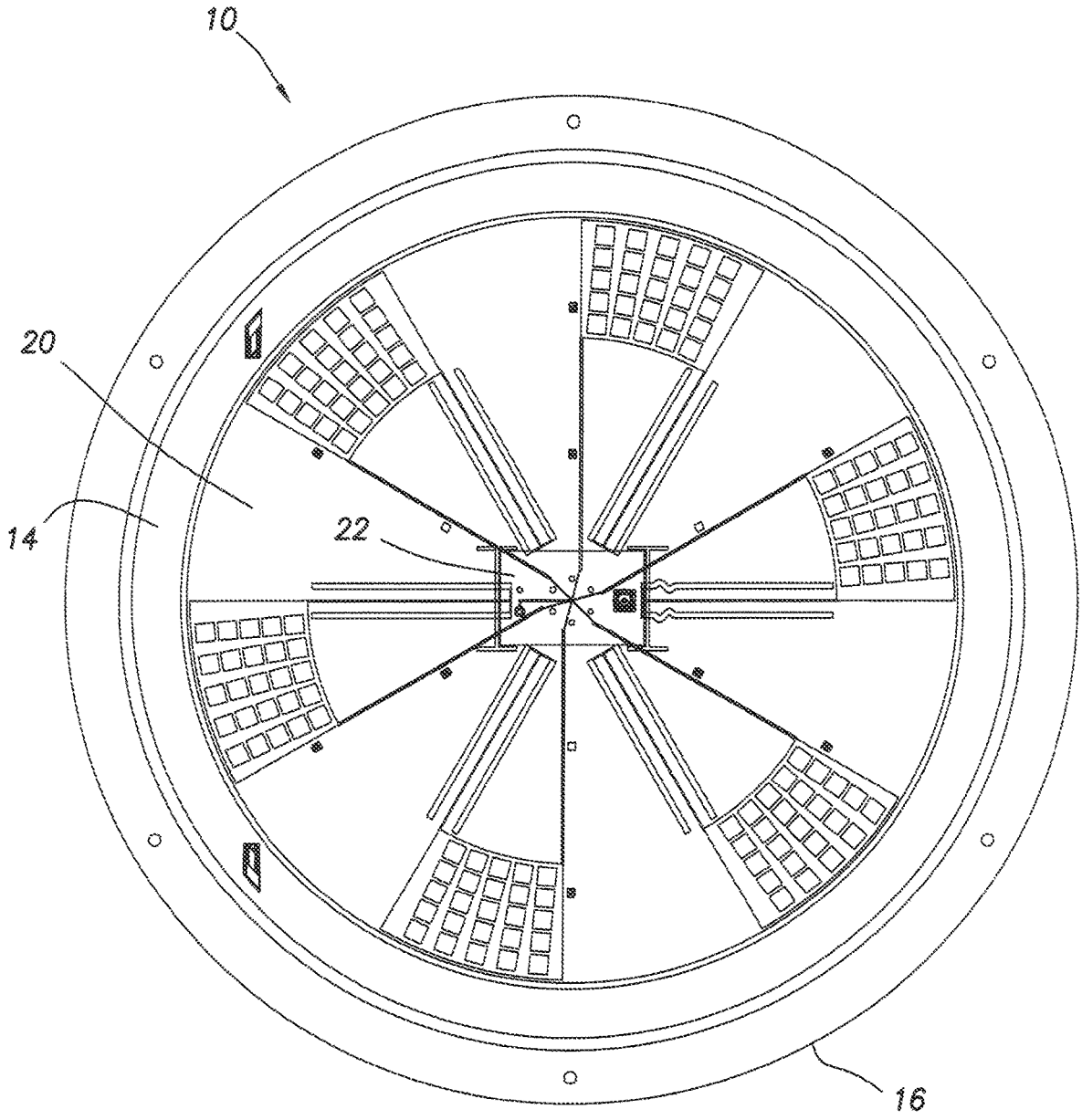
FIG. 3 is a bottom view of the stackable antenna enclosure 10 corresponding to FIGS. 1 and 2.
Figure 4:
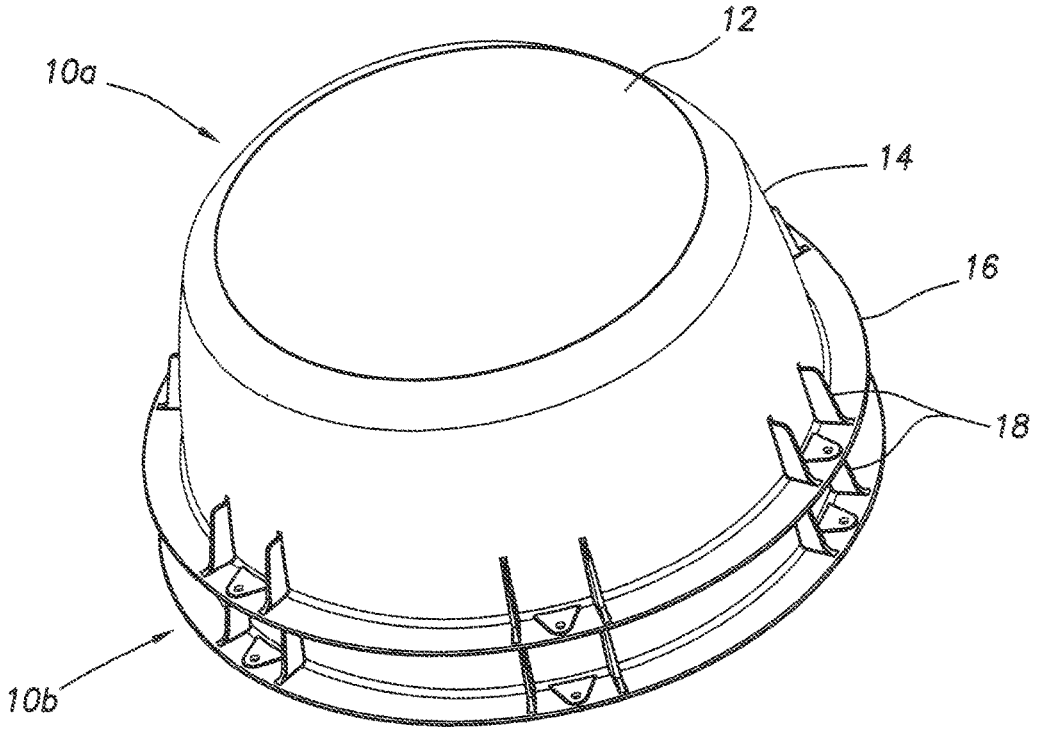
FIG. 4 is a top axonometric view of two antenna enclosures 10*a*, 10*b* stacked together.
Figure 5:
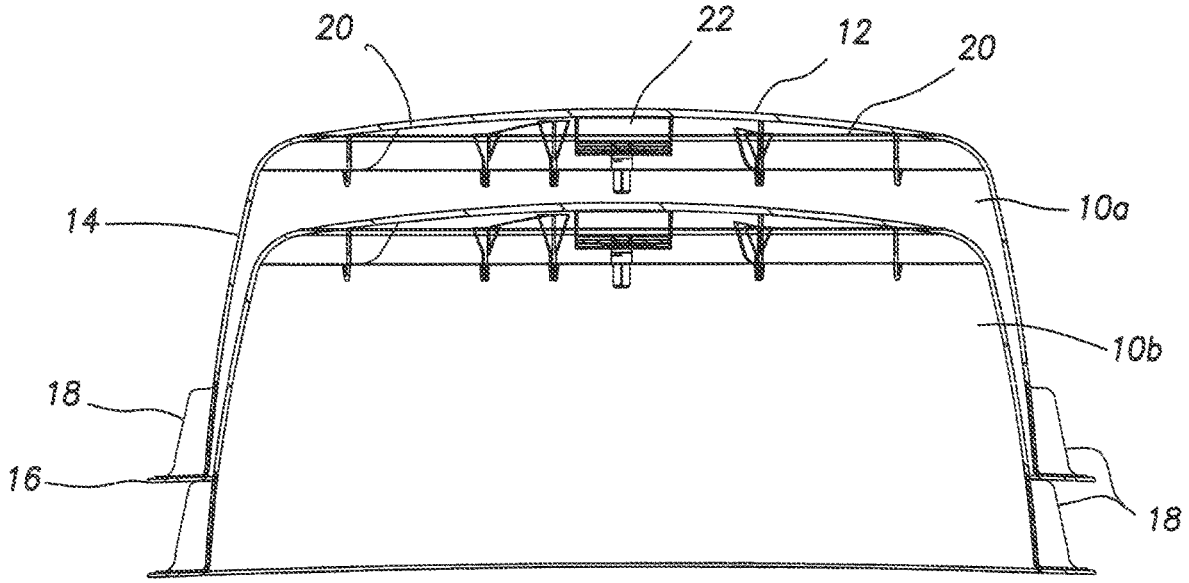
FIG. 5 is a side cross-sectional view of two antenna enclosures 10*a*, 10*b* corresponding to FIG. 4

FIGS. 1-3 illustrate an embodiment of a stackable antenna enclosure 10 in accordance with the present invention. Preferably, the enclosure 10 is generally dome-shape with a top 12 and a side wall 14 tapering inward from the base 16 to define a cavity within the enclosure 10. The overall shape of the enclosure 10 can be generally hemispherical or it can have a truncated conical shape. However, the enclosures 10*a*, 10*b* should capable of being stacked or nested together, as shown in FIGS. 4 and 5, so that the top 12 and upper portion of the side wall 14 of an enclosure 10*b* can be inserted into the cavity of an adjacent enclosure 10*a* above.

An antenna 20 and its associated electronic components 22 (e.g., a pre-amplifier, electrical connectors and wiring) are mounted to the interior surface of the top 12 of the enclosure 10, as shown in the bottom view provided in FIG. 3. The antenna has a relatively flat profile, but does extend downward by a small distance into the interior cavity of the enclosure 10 as shown in FIG. 2. When installed on a structure or vehicle, the enclosure 10 protects the antenna 20 and associated electronic components 22 from the elements and also provides a cover for any roof penetrations of the vehicle or structure that the enclosure 10 is mounted to. The enclosure 10 provides additional height above the mounting surface (i.e., a stand-off distance) to separate the antenna 20 from the vehicle or structure, and thereby enhances the performance of the antenna 20.

The enclosure 10 is equipped with a number of stops 18 that extend from side wall 14 as illustrated in FIGS. 1 and 2. Preferably, these stops 18 extend outward from the exterior of the side wall 14 at intervals around its periphery at a predetermined elevation above the base 16. As shown in FIGS. 4 and 5, these stops 18 limit how far the enclosure 10*b* can be inserted into the interior cavity of an adjacent enclosure 10*a* when these enclosures 10*a*, 10*b* are nested together. This protects the antenna 20 and related electronic components 22 by preventing them from coming into contact with the top 12 of the adjacent enclosure 10*b*.

In the embodiment of the present invention shown in the drawings, the stops 18 are a set of at least three vertical ribs or protrusions on the outside of the sidewall 14 of the enclosure 10 adjacent to its base 16. Preferably, each stop 18 has a substantially horizontal upper edge. When two enclosures 10*a* and 10*b* are stacked, the base 16 of the upper enclosure 10*a* rests against the tops or upper edges of the ribs 18 of the lower enclosure 10*b* as shown in FIGS. 4 and 5. The vertical height of the ribs 18 defines a maximum depth of insertion for nesting the enclosures 10*a*, 10*b* and thereby maintains a minimum vertical separation between the antenna 20 (and its related components 22) and the top of an adjacent enclosure 10*b* below, as shown in FIG. 5. Thus, the antenna 20 and related components 22 are protected within the upper part of the cavity remaining between the stacked enclosures 10*a* and 10*b*. The sloping sidewall 14 of the enclosure 10*a* also prevents contact with the outer parts of the enclosure 10*b* nested within.

Other possible embodiments of the stops 18 include a series of ribs or protrusions on the inside of sidewall 14 to contact the top or upper sidewall of an adjacent enclosure. Alternatively, a circumferential lip could extend outward or inward from the sidewall 14 of the enclosure 10. If the lip extends outward, this lip would contact the base of an adjacent enclosure above. If the lip extends inward, the lip would contact the top or upper sidewall of the adjacent enclosure below. A circumferential lip could also extend inward from the base 16 of the enclosure 10 to contact the sidewall of an adjacent enclosure.

Figure 6:
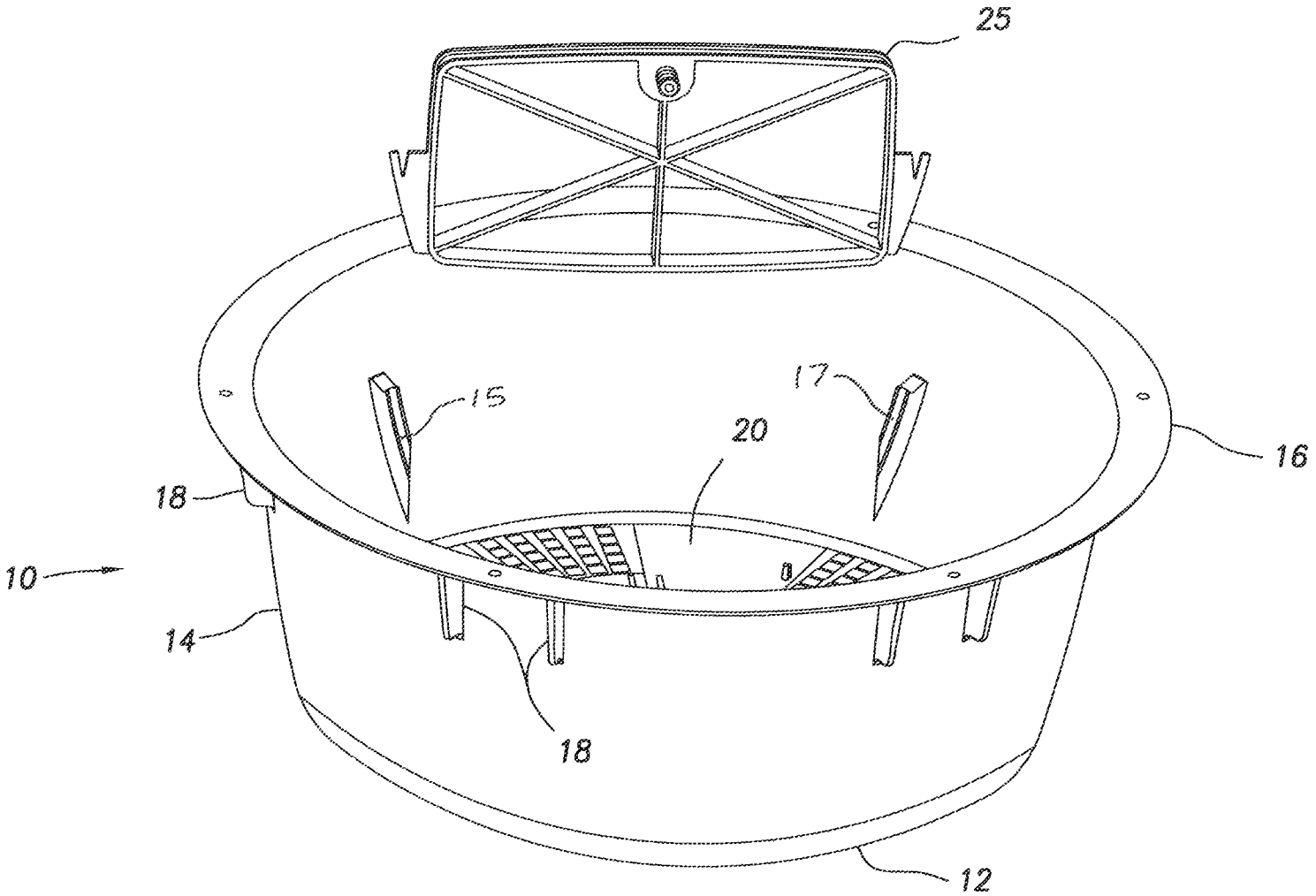
FIG. 6 is a bottom axonometric view of an alternative embodiment of an antenna enclosure 10 with slots 15, 17 on its interior side wall 14 for mounting a second antenna 25.
Figure 7:
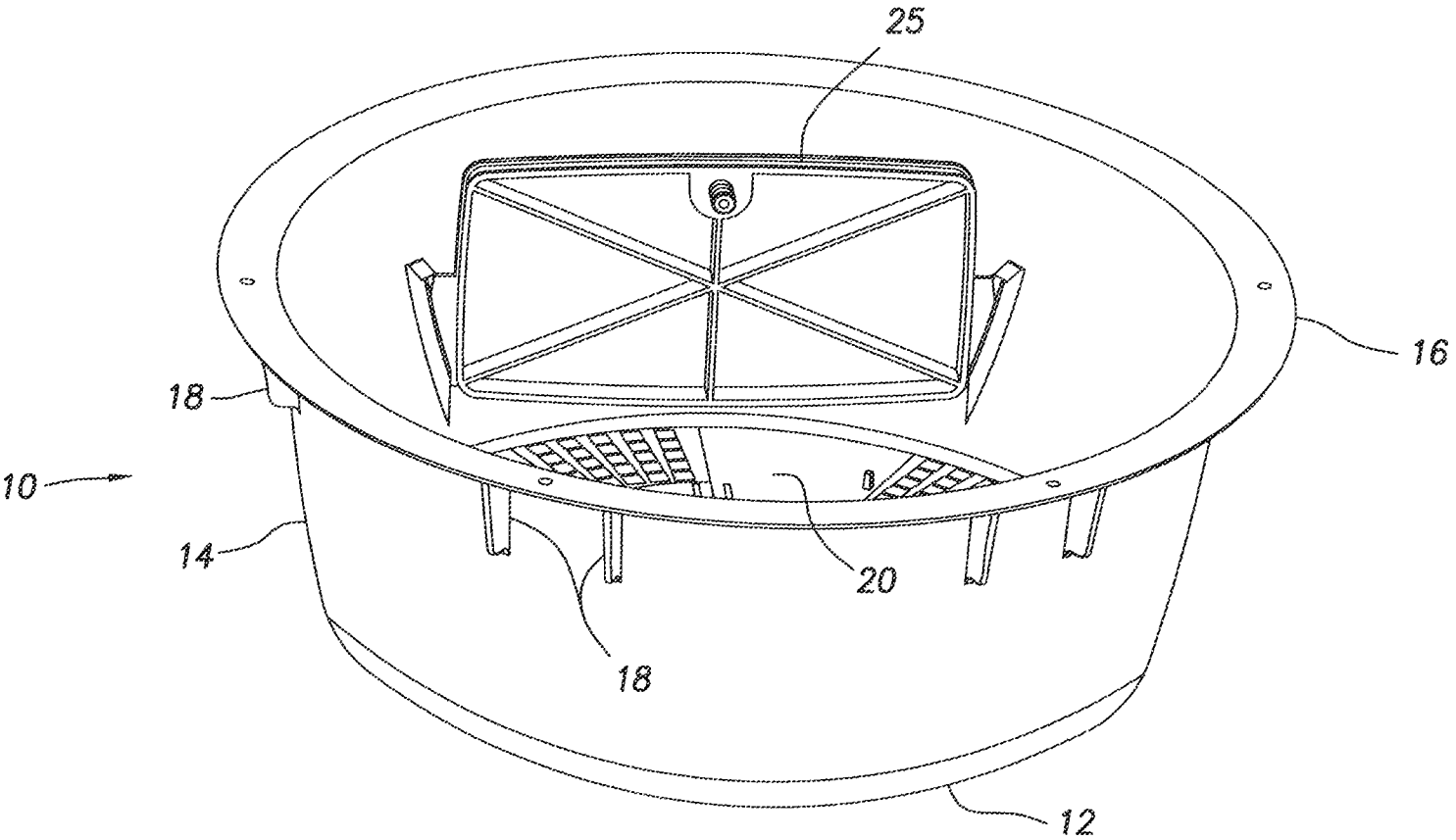
FIG. 7 is a bottom axonometric view corresponding to FIG. 6 after the second antenna 25 has been mounted in the slots 15, 17.

FIGS. 6-7 show an embodiment of the present invention that includes slots 15, 17 for mounting electronic devices on the interior side wall 14 of the enclosure. For example, a second antenna 25 can be equipped with opposing ears or projections that slide into these slots 15, 17 to mount the antenna 25 (e.g., an AM loop antenna) within the interior cavity of the enclosure, as shown in FIG. 7. The slots 15, 17 could also be employed for mounting other types of electronics modules (e.g., a 4G or wi-fi module) within the enclosure. Multiple sets of such slots could be used to mount multiple antennas or other electronics devices within the enclosure.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A stackable antenna enclosure comprising:

a base;

a top with an interior surface;

a side wall with interior and exterior surfaces tapering inward from the base to the top to define an interior cavity;

at least one stop extending from the side wall; and an antenna housed within the interior cavity adjacent to the interior surface of the top;

wherein a plurality of enclosures can be stacked together with the at least one stop limiting insertion of a first enclosure into the interior cavity of an adjacent second enclosure, thereby preventing the top of the first enclosure from contacting the antenna within the second enclosure.

2. The stackable antenna enclosure of claim 1 wherein the at least one stop extends outward from the exterior surface of the side wall.

3. The stackable antenna enclosure of claim 1 wherein the at least one stop comprises a number of vertical ribs spaced around the exterior of the side wall adjacent to the base.

4. The stackable antenna enclosure of claim 3 wherein the ribs extend upward from the base and further comprise an upper lip to abut the base of an adjacent enclosure.

5. The stackable antenna enclosure of claim 1 wherein the at least one stop comprises a circumferential lip on the side wall of the enclosure.

6. The stackable antenna enclosure of claim 1 wherein the at least one stop comprises a number of protrusions extending outward from the side wall of the enclosure.

7. The stackable antenna enclosure of claim 1 further comprising:

a plurality of slots on the interior surface of the side wall; and a second antenna engaging the slots to thereby mount the second antenna within the interior cavity.

8. A stackable antenna enclosure comprising:

a base;

a top;

a side wall tapering inward from a base to the top to define a dome-shaped interior cavity with an interior top surface;

an antenna mounted on the interior top surface; and at least one stop extending outward from the side wall with an upper surface at a predetermined elevation above the base;

wherein a plurality of enclosures can be stacked together with the upper surface of the stop contacting the base of an adjacent enclosure and limiting insertion of the enclosure into the interior cavity of the adjacent enclosure, thereby preventing the top of the enclosure from contacting the antenna within the adjacent enclosure.

9. The stackable antenna enclosure of claim 8 further comprising a plurality of stops spaced around periphery of the side wall adjacent to the base.

10. The stackable antenna enclosure of claim 8 wherein the stop extends upward from the base with a horizontal upper edge abutting the base of an adjacent enclosure when stacked.

11. The stackable antenna enclosure of claim 8 wherein the stop comprises a vertical rib extending radially outward from the side wall, with an upper end abutting the base of an adjacent enclosure when stacked.

12. The stackable antenna enclosure of claim 8 wherein the stop comprises a circumferential lip extending outward from the side wall above the base.

13. A stackable antenna enclosure comprising:

a dome having a top, a base, an exterior surface and an interior surface defining an interior cavity;

an antenna mounted on an upper portion of the interior surface of the dome;

at least one stop extending outward from the exterior surface of the dome with an upper surface at a predetermined elevation above the base; and wherein a plurality of enclosures can be stacked together with the upper surface of the stop contacting the base of an adjacent enclosure and limiting insertion of the enclosure into the interior cavity of the adjacent enclosure, thereby preventing the top of the enclosure from contacting the antenna within the adjacent enclosure.

14. The stackable antenna enclosure of claim 13 further comprising a plurality of stops spaced around periphery of the side wall adjacent to the base.

15. The stackable antenna enclosure of claim 13 wherein the stop extends upward from the base with a horizontal upper edge abutting the base of an adjacent enclosure when stacked.

16. The stackable antenna enclosure of claim 13 wherein the stop comprises a vertical rib extending radially outward from the side wall, with an upper end abutting the base of an adjacent enclosure when stacked.

17. The stackable antenna enclosure of claim 13 wherein the stop comprises a circumferential lip extending outward from the side wall above the base.

* * * * *